United States Patent [19]

Schmidt

[11] Patent Number: 4,592,212

[45] Date of Patent: Jun. 3, 1986

[54] CIRCULAR KNITTING MACHINE FOR THE PRODUCTION OF CUT PILE

[76] Inventor: Walter R. Schmidt, Dr. Gschmeidler-Str. 19/2, 3500 Krems/Donau, Australia

[21] Appl. No.: 451,863

[22] Filed: Dec. 21, 1982

[30] Foreign Application Priority Data

Dec. 22, 1981 [AT] Austria ..... 5512/81

[51] Int. Cl.[4] ..... D04B 9/12; D04B 35/00

[52] U.S. Cl. ..... 66/91

[58] Field of Search ..... 66/9 R, 12, 91, 92, 66/93

[56] References Cited

U.S. PATENT DOCUMENTS

| | | | |
|---|---|---|---|
| 579,621 | 3/1897 | Wever | 66/91 |
| 1,441,110 | 1/1923 | O'Lena | 66/93 |
| 1,596,527 | 8/1926 | Grundy | 66/93 |
| 3,874,197 | 4/1975 | Plath | 66/12 |
| 4,026,126 | 5/1977 | Nuber | 66/9 R |
| 4,043,151 | 8/1977 | Schmidt | 66/9 R |
| 4,409,800 | 10/1983 | Gutschmit et al. | 66/9 R |

FOREIGN PATENT DOCUMENTS

| | | | |
|---|---|---|---|
| 2322384 | 11/1974 | Fed. Rep. of Germany | 66/92 |
| 2423700 | 11/1975 | Fed. Rep. of Germany | 66/93 |
| 2704295 | 8/1978 | Fed. Rep. of Germany | 66/9 R |
| 138227 | 10/1979 | German Democratic Rep. | 66/91 |
| 739151 | 6/1980 | U.S.S.R. | 66/93 |

*Primary Examiner*—Wm. Carter Reynolds

*Attorney, Agent, or Firm*—Cushman, Darby & Cushman

[57] ABSTRACT

A circular knitting machine for the production of cut pile has latch needles (N) in the dial (R) and pile elements (11) in the cylinder (Z). Each pile element has an upper pile forming portion (11*a*) for example shaped like a hook, and also, spaced substantially therebelow, a cutting edge (11*c*) which cooperates with an opposed separate cutting edge (12*c*) of a cutting element (12). Cutting is effected thereby in the direction transverse to the axis of the cylinder (Z). Pile loops (H) are pulled downwardly by the fabric take down (arrow W) from the pile forming portion (11*a*) to the cutting edge (11*c*) sufficient time being available, before they are cut, to extend the pile loops (H) as desired and to tension the needle stitches over the just formed pile loops (H). The opposed cutting edge (12*c*) can be angled or skewed with respect to the cutting edge (11*c*) so that even with fine gauges, a real scissor action is guaranteed with only point contact of the cutters. Fine gauges are not excluded on account of the fact that the opposed cutting edges (12*c*) operate neither in the slot for the pile elements in the cylinder (Z) nor in the area of the needles (N).

15 Claims, 13 Drawing Figures

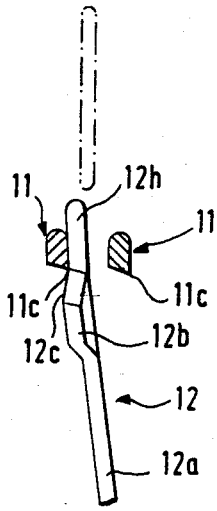
FIG.6
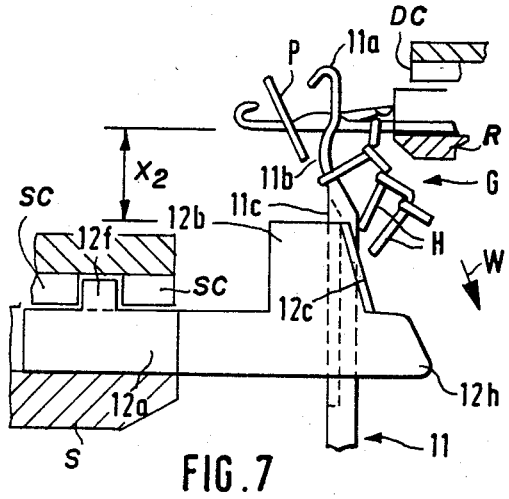
FIG.7
FIG.8
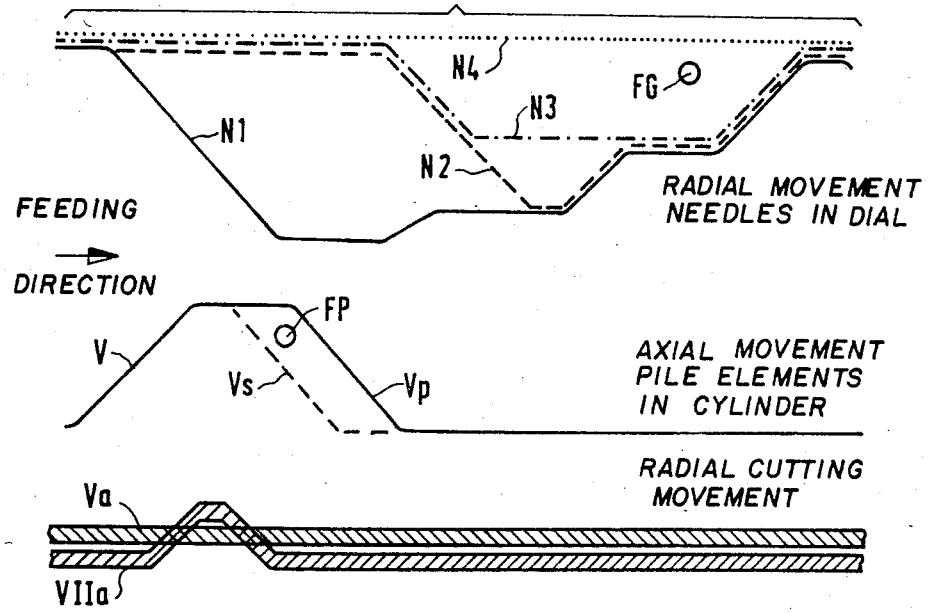

CIRCULAR KNITTING MACHINE FOR THE PRODUCTION OF CUT PILE

BACKGROUND OF THE INVENTION

1. Field of the Invention

The invention relates to a circular knitting machine particularly suited for the production of cut pile.

2. Description of the Prior Art

The integrated cutting of pile loops in the knitting machine is of particular commercial importance, as a subsequent cutting by a shearing process during finishing results in a high waste of pile material and requires additional finishing steps.

Known methods to solve this problem by severing pile loops in the knitting machine have fallen into four groups.

In the first group the pile loops are severed by being drawn over a sharp knife-like cutting edge which penetrates as a result of its extension into the pile loop and thus severs it. As for example is already known from U.S. Pat. No. 1,546,790, the cutting edge can be a an extension of the pile forming edge on a sinker which is positioned in a sinker ring. Similarly, the cutting edge can be provided at a pile element arranged in the cylinder in the manner described in West German Specification No. 2,917,378 or last German counterpart 138,227. The cutting edge is there inclined with respect to the direction in which the pile elements retract and is positioned so that the pile loop is drawn during the retraction of the pile element until it is severed on the cutting edge. Furthermore, such a cutting edge can be arranged on the shank of a hooked pile element underneath the hook, as is shown for example in West German Specification No. 2,704,295. The pile loop formed by the hook is pressed down by a holding down wheel while the pile element is raised to such an extent in which the cutting edge will tear the drawn loop while the needles remain in miss position. It is obvious that extending or stretching the pile loop to sever it raises to problems in a number of respects and as a result is relatively unreliable. Reliable severing can only be assured over long periods if pile material is used as fine as possible and having a low twist with a low tenacity and and also having a very limited elasticity, so that the pile loop is actually severed simply by drawing if over a cutting edge. Since the stretched pile loop slides over the cutting edge, the cutting edge is quickly worn, which results in broken pile elements and thus fabric faults, machine stoppage and high replacement costs for pile and/or cutting elements. These disadvantages can be avoided to a certain extent if an independently movable knife-like cutting member is arranged between adjacent pile elements or lamellae as taught in U.S. Pat. No. 4,026,126, which hold the pile thread extended for cutting by the moving cutting element. The movable cutting element is provided with an upper sloping cutting edge and is moved upwards between the pile elements (located in the cylinder) and between their hooks, in order to sever the pile loop increasing their extent. Although substantial wear might be expected, the above-mentioned disadvantages are substantially reduced in such a circular knitting machine, but other disadvantages result which will be further explained below.

In the second group of methods the pile loops are severed by being crushed by a crushing wheel. For example according to the teaching of U.S. Pat. No. 1,596,527, the pile loop is formed over a pile element located in the dial, the pile element is then supported from beneath and a crushing wheel is pressed on it from above, in order to crush the pile loop. In the example of U.S. Pat. No. 3,933,907 hooked pile elements located in the dial form the pile loop which is subsequently abraded by a crushing wheel. In British Pat. No. 891,937 the pile loop is formed over an arcuate sinker neb and slides rearwardly thereon by subsequent knitting operations, where it is engaged by a crushing wheel and abraded. Such crushing or abrading of pile loops can however only be satisfactorily accomplished if sufficient time is allowed for it. This is only possible with low speed machines. Special problems result when using high tenacity yarns.

In the third group of methods the pile loops are transferred to a separate cutting element where they are cut. One of the two portions of the pile loop is so offset with regard to the other—by a correspondingly formed dial according to British Pat. No. 813,357 or by a displacement wheel according to British Pat. No. 849,710—that a transfer element can be introduced into the pile loop, which serves as support during cutting. Such an insertion of cutting elements and supports into the pile loop is, however, only possible in coarse cut machines, as with finer cuts the two portions of the pile loop are too close to each other and cannot with the necessary degree of certainty be brought into such offset or staggered relationship.

In the fourth group of methods to sever pile loops, the severing is effected by two cutting edges movable relative to each other. In German Pat. No. 1,153,482, movable pile elements are arranged in the dial having upright projections on their outer ends with cutting edges on the dial side of the projections. In the same slots of the dial, side by side to the pile elements, fixed cutting elements are dispersed, projecting with their cutting edges on the outer ends of the dial. Pile loops are formed on the shanks of the pile elements adjacent the cutting edges and by retracting the pile elements and the loops, their cutting edge will contact the cutting edge of the cutting element and in cooperation they will cut the pile loops. In an improvement, known from West German Pat. No. 1,585,051, the cutting elements are slightly pre-bent, so that the cutting edges of the cutting elements are resiliently pressed against the cutting edges of the pile elements to avoid a deflection from the cooperating cutting edges under cutting conditions. It is also known from German Patent specification No. 2,423,700 to arrange a movable hooked pile element tightly in a U-shaped cutting element having cutting edges on both sides so as to cooperate with the cutting edge of the pile element which is a portion of the hook when the elements are moved relative each to each other subsequent to the knitting process.

As a result of the cooperation of two cutting edges when moving at least the pile elements unlike in the first group of methods with only one cutting edge, the serving is not realized by an increased extent of the pile loop, but rather by relative movement of the cutting edges without any substantial additional extending of the pile loop. Furthermore the pile loops do not need to run under tension over the cutting edges so that by virtue of a cutting concept with relatively movable cutting edges both the abrasion of the cutting edges by the rubbing effect of the pile loops is reduced and the abrading of the pile thread, completely or partly by drawing over the cutting edge is avoided when the pile loops are formed. However, one particular disadvantage of such an arrangement is that the pile elements and the cooperating cutting elements, which in the example of West German Patent specification No. 2,423,700 is moreover arranged on either side of the shank of the pile element, must be arranged in the same slot and be capable of relative movement therein. The relative movement of elements side by side presupposes that increased friction must not occur between the elements. The necessary tolerance for an easily relative movement is detrimental to the cutting process, since then the cutting edge and the cooperating cutting edge must either have a corresponding relative tolerance, as in the example of DE-OS No. 2,423,700, or they can be relatively easily flexed away from each other by the pile loop, as in the example of DE-PS No. 1,153,482. Even with elastic compression of the stationary cutting element towards the pile element as is provided in the example of DE-PS No. 1,585,051, such a gap cannot be avoided, as on account of the necessary relative movability only light elastic compression can be exerted, which then makes it possible to still deflect the cutting edge of the pile element from cooperating cutting edge. Thus as soon as the cutting edges exhibit first effects of wear and if additional interfering factors unavoidable in practice add their effects such as damage or even only contamination of the elements which are moved against one another such as by fibre dust or solidified lubricant, the pile loop is no longer cut, but merely jammed therebetween.

A still greater basic disadvantage of these methods of arranging at least two relatively movably side by side elements in the same slot that also is to be avoided in moving knife-like cutting element of U.S. Pat. No. 4,026,126 between adjacent pile elements lamellae directs in that it necessitates too coarse a cut of the machine. The overwelming majority of pile machines are built with 18 or 20 cut per inch (Imperial). Of the—at best—1.4 mm per needle available, 0.5 mm is already occupied by the cut itself. The pile elments must be extended between the needles, and an unavoidable predetermined space has to be left between the needles and the pile elements for looping the pile. On that account the pile element can only have a thickness of at most 0.5 mm. This results that in the examples of German Pat. Nos. 1,153,482 and 1,585,051 the pile elements and the cooperating cutting elements can only be at most about 0.25 mm thick. Because of this neither an adequate compression of the two cutting edges onto the other nor an adequate inflexibility of the cutting edges can be achieved, so that such small element thicknesses are not acceptable in practice. Thus a coarser cut of the knitting machine is required.

In all known possible methods of integrated severing of the pile loops into the knitting machine, there is the common problem produce a equal pile side and a uniform stitch structure, in which the base thread covers the pile thread on the stitch side by plating. When the needles are being extended, the stitches are enlarged by forcing the latch open and clearing the latch and also during retraction as the the needle hook is being pulled through. As the needle loops of the base fabric are connected wale-wise and course-wise, they afterwards reassume their original form. If the pile loops, however, are severed subsequent to the knitting process, there is no longer any possibility of retraction of the enlarged stitch loops of the pile thread until a subsequent course is knit. When knitting, the pile threads into the needle stitches of the base fabric it is desired to produce a uniform pile and stitch structure which is effected when the pile loops are maintained at least partially until extended the stitches are cleared from the needles by the subsequent course, and therefor no further protruded needle loops of the pile-threads are avoided as a result of their frictional connection to the acting needles.

Several methods of preventing enlarged stitches are known. Some of them are disclosed in various embodiments of a known circular knitting machine according to West German Specification No. 2,918,203, in which the severing of the pile loops is also realized corresponding to the above-mentioned first group of known methods similar to the teachings of West German Specification No. 2,704,295, so the the pile elements, after clearing the stitches of the previously knitted course from the needles, the needles are moved and the pile loops are severed by a cutting edge disposed opposite the hook opening and cooperating with a blade, pressing the pile loops against the dial. The elements are therefore arranged in the dial. According to the embodiment of FIGS. 2 to 9 of West German Specification No. 2,918,908 and also according to the teaching of East German Specification No. 136,227 or U.S. Pat. No. 1,596,527, subsequent to each pile course, a single threaded course is knit to clear the pile threads from the needles. Because of this, the pile is naturally less dense while the number of pile loops projecting from the base fabric is halved. According to the embodiment of FIGS. 10 to 19 of West German Specification No. 2,918,903 two pile hooks are arranged in each slot of the dial which alternately form and sever the pile loops; this results as explained above in detail with a coarse cut of the machine according to the required measurement of the pile elements, and moreover mutual interference between the pile elements and jamming of the pile loops may occur instead of its being severed. According to the embodiment of FIGS. 20 to 25 of West German Specification No. 2,918,903 and to the teaching of West German Specification No. 1,153,482 each course is knit only have a portion of the needles and pile elements; because of this, however, only a portion of a course is knit which is completed by the subsequent feeder and the productivity of the knitting machine is halved.

A fundamentally different possibility for a reprotruding the stitches of the pile thread by extending the pile loops is known from British Pat. No. 891,973 which belongs to the above described second group of methods and in which the pile loops are formed over curved sinker nebs in the dial, but are not severed immediately after their formation. Rather the pile loops slide rearwardly on the curved sinker neb while subsequent pile loops are knitted. Each pile loop is severed by means of an abrading wheel when the subsequent stitch of the pile thread has been completely knocked over, so that the severed pile loop then clears the sinker neb and can be pulled off by the fabric take-down. The curvature of the sinker neb is chosen so that the take-down friction causes the knitted pile loops to slide into the area of the abrading wheel. This requires the actual pile forming edge of the curved sinker neb be substantially horizontal or only slightly inclined to prevent the pile loops from sliding away undefined when they are formed by the cylinder needles. At the same time, the fabric take-down friction, acting in the same direction, must also effect a sliding movement of the pile loops along the curved sinker neb, even through the take-down strength acts substantially normally to the pile forming edge where the pile loop is formed on the sinker neb. In this manner the pile loops on the sinker nebs substantially hinder take-down and require high take down strength without precluding disturbances if e.g., different yarns with different friction on the sinker nebs are to be used. The high strength acting on the sinker nebs, to which must yet be added the pressure of the crushing wheel, necessitated a rugged construction for the sinker nebs which again results in the need to have a correspondingly coarse cut of the machine.

Naturally, the knitting latch needles have no effect on the pile threads if these are knitted into the base fabric by tuck stitches, described in the example of U.S. Pat. No. 2,933,907, West German Specification No. 2,704,295, West German Specification No. 2,423,700 and U.S. Pat. No. 4,026,126. By virtue of substantially extending free cutting of the pile loops according to the present invention, protruding pile loops are prevented so the pile thread is knitted to tuck stitches.

SUMMARY OF THE INVENTION

It is an object of the invention to provide an improvement over circular knitting machines of the general type described in U.S. Pat. No. 4,026,126 in which latch needles are positioned in the dial and pile elements in the cylinder, and in which to each pile element—here comprising two parallel, closely spaced pile elements lamellae—is arranged a relatively movable cutting element for cutting the pile loop. For each bicomponent pile element, therefore, together with the movable cutting element, the slot in the cylinder requires a width corresponding to the thickness of the three parts, generating a correspondingly coarse cut for the cylinder and dial. This coarse cut cannot be made finer because of the necessary dimensions of the elements in the cylinder, which must extend between adjacent needles. The severing itself is realized immediately subsequent to knitting of the base fabric by the hooks of the bicomponent pile elements cooperating with the projecting cutting element, so that the above described problems of not maintaining an extended pile loop to effect a clean jersey side of the fabric for knitting in the pile thread into the needle stitch would be encountered. The special knitting structure of the pile threads into the base fabric by means of special needles as specifically taught in U.S. Pat. No. 4,026,126 reduces the protruding of pile stitches Knitting the pile threads into needle stitches according to the above described severing method to produce uniform and clean stiches would not be possible.

It is another object of the invention to construct circular knitting machines of this general type with which a cut pile can be produced in fine gauge if so required and with any desired stitch construction by knitting of the base and pile threads all this without influence to the knitting process by the severing process.

BRIEF DESCRIPTION OF THE INVENTION

In one aspect, the invention relates to a circular knitting machine for knitting a cut pile fabric, with a dial and a cylinder where movable latch needles are arranged in the dial and pile elements as positioned in the cylinder, said pile forming elements having a pile forming edge. Spaced thereform, a cutting edge on to which pile loops previously formed on the pile forming edge slides by knitting subsequent courses, and an associated cooperating cutting element with a cooperating cutting edge which is actuated to and fro rectangular the said cutting edge to sever the loops.

The cutting element may be pivotally supported on the pile forming element and preferably so that it is arranged radially outwardly thereof with respect to the axis of the cylinder.

Alternatively, the cutting elements can be positioned in slots of a dial ring located radially outwardly of the cylinder.

In any event, the cutting element can have a cutting edge whch can be skewed with respect to the cutting edge of the pile forming element to effect the severing scissor like.

While the forming pile elements are arranged spaced beneath the latch needles when they cooperate with the cutting edges of the cutting elements the severing of the pile loops is effected, delayed if desired with respect to the formation of the loop in correspondence with the chosen distance from the pile forming edge to the cutting edge, when at least one additional pile loop is knitted and will not be influenced by the cutting edges. This advantage corresponds in substance to the method described in British Pat. No. 891,973, i.e. avoiding an unsightly appearance of the jersey side by a subsequent severing of the pile loops by effecting the severing process independently from the knitting process so that the knitting process can no longer be affected. In contrast to the teaching i.e. British Pat. No. 891,973 however, this method is realized according to the invention with forming elements arranged in the cylinder, on which the pile loops can slide from the pile forming edge to the upper end of the cutting edge without hindering the fabric take down in the defined direction thereof. Therefore the knitted fabric is held on the upright pile forming elements until it is cleared by severing the pile loops. This has no disadvantageous effect to the take down mechanism nor to the knitting process, so that according to the invention the method of producing a regular fabric with a desired appearance, as is it is basically known from British Pat. No. 891,973, can be readily used, and is, in the invention, without any problem or difficulty by the simple measure of arranging the cutting elements below the latch needles cooperating in this level with the cutting edge of the pile elements.

The cutting edges of the pile elements are upright, thus substantially parallel to the axis of the cylinder, and cooperate with the cutting edge of the cutting element. In contrast to knitting machines according to U.S. Pat. No. 4,026,176 the pile elements do not simply extend or stretch the pile loops to allow tearing by a knife-like cutting element, but themselves have a cutting edge which cooperates with the cutting edge of the cutting element in a scissor-fashion. The cutting element is for this reason projected in a direction transverse to the cutting edge of the pile forming element, thus transverse to the cylinder axis and not parallel to it as in the case of U.S. Pat. No. 4,026,126. Therefore, it is possible to arrange the cutting element independently of the pile forming elements in a slot of a sinker ring and thus does not increase the width of the slots for the pile forming elements in the cylinder with a consequent coarseness of the cut. It is only necessary to effect relative movement between the pile forming element and the cutting element each to the other for the actual cut in the axial region of the cutting edge of the pile forming element which is arranged at this time below the level of the latch needles in the dial and above the slots of the cylinder. Even in fine cuts there is enough space for the cooperating cutting edges of the cutting elements to slide in contact beside the cooperating pile forming elements. This gives a highly stabilized arrangement of both cutting edges and in a preferred embodiment of the invention there is even a relative skewing of the cooperating cutting edges of the cutting element and the cutting edge of the pile element so as to produce a real scissor-like effect for realizing a clean and safe cut and an automatic sharpening of the cutting edges and cooperating cutting edges. It is of considerable importance, moreover, that all projections required for the severing can be actuated simultaneously and independently of the projection required for stitch and loop formation, and therefor without any decrease of productivity resulting from a separate severing action.

The distance from the pile forming edges to the cutting edges and also the length of the cutting edges of the pile element and the substantially corresponding length of the cooperating cutting edges of the cutting element can be made sufficient so that a plurality of as yet uncut pile loops can string on the pile forming element and then slide into the area of the cutting edges.

The distance from the upper end of the cutting edge and the pile forming edge is, with knitting in the pile thread, in stitches of the basic fabric chosen such that an extending of the previously knitted pile loops is possible until the subsequent course is knitted for producing a firm stitch construction, as is above explained with respect to the effect of delayed cutting. With tucking in the pile threads this is also advantageous in order to counteract pulling out of the pile loops, though not always necessary; rather in this example the distance from the pile forming edge to the cutting edge can be reduced to the extent that the cutting can be effected immediately after formation of the pile loop to be cut. In all embodiments, however, the space where a fine machine cut is desired is chosen so that cutting of the cutting is effected below the dial needles, so that the mutual cut of the machine does not need to be increased for the integrated cutting feature.

As to the length of the cutting edge, it is to be observed that each pile loop is severed as soon as it slides within the axial extent of the cutting edge of the pile and the cooperative cutting element and the cutting motion is effected. A substantial length of the cutting edge results to a safety factor to operating faults in the example where the cutting projection is affected by wear, as an uncut pile loop can slide along the cutting edge and is presented in the same position several times under the condition of the cooperating cutting edges. Alternatively, to produce the desired control, cutting can be executed intermittently since knitting a plurality of courses with a corresponding number of pile loops having accumulated on the cutting edge of the pile forming element, so that the safety factor referred to can be partly waived in favor of a reduction in the number of cutting strokes.

BRIEF DESCRIPTION OF THE DRAWINGS

The invention will now be further explained with reference to the embodiments shown in the drawings.

FIG. 6 is a section on the line VI—VI of FIG. 4 illustrating at the same time an alternative embodiment of the arrangement of the cutting edges, in which the position of the needles is shown in dashed lines, FIG. 7 a view like FIG. 4 in another operating position of the knitting machine, FIG. 8 a diagram like FIG. 3 showing the movements of the needles, pile elements and cutting elements of the embodiment shown in FIGS. 4 to 7 in one possible mode of operation, FIG. 9 a modified pile forming element in a view like that of FIG. 5, FIG. 10 another modification of the pile forming element in a view like that of FIG. 9, FIG. 11 a side view of the embodiment of FIG. 10

DETAILED DESCRIPTION OF THE PREFERRED EMBODIMENTS

Figure 1:
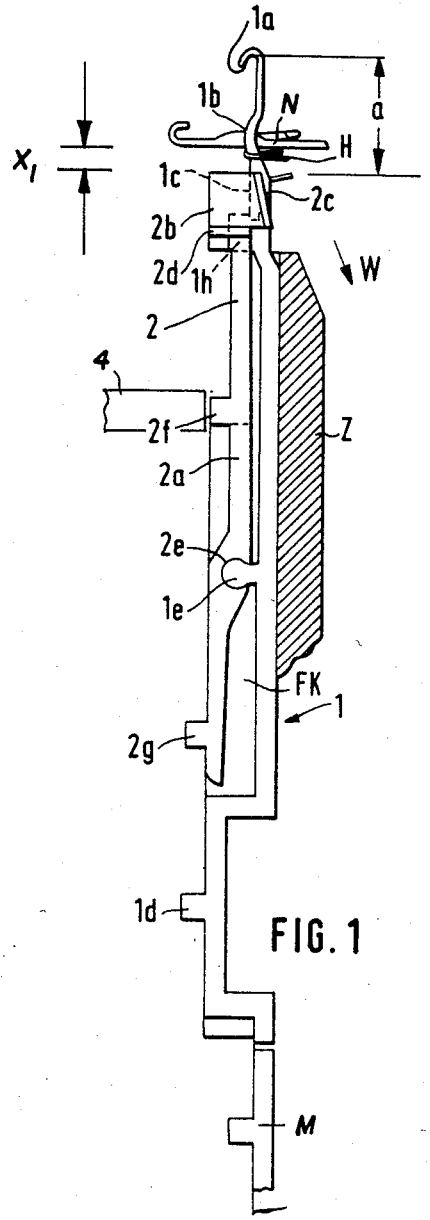
FIG. 1 a partial section through a circular knitting machine according to the invention is simplified, schematic form illustrating a first embodiment of a pile element with a cutting member, in side elevation, FIG. 2 a view like FIG. 1 in a different operating position of the pile and cutting element, FIG. 3 a diagram showing the movement of the needles, the pile elements and cutting elements in a possible mode of operation of the knitting machine of FIGS. 1 and 2, in which the curves correspond to the cam tracks controlling the needles, pile elements and cutting members, FIG. 4 another embodiment of the invention in a view substantially corresponding to FIGS. 1 and 2, FIG. 5 a section on the line V—V of FIG. 4.
Figure 2:
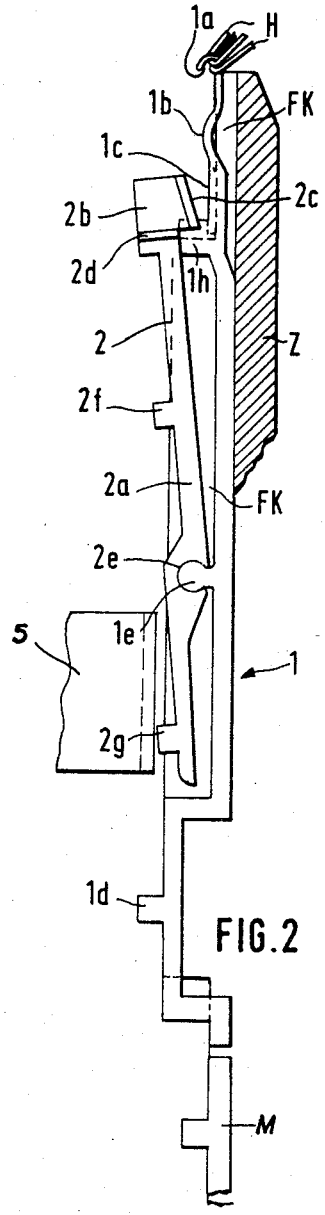
Figure 4:
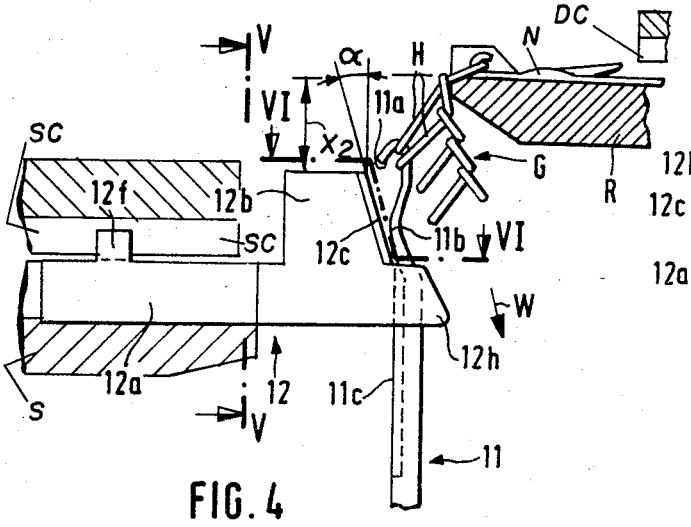
Figure 12:
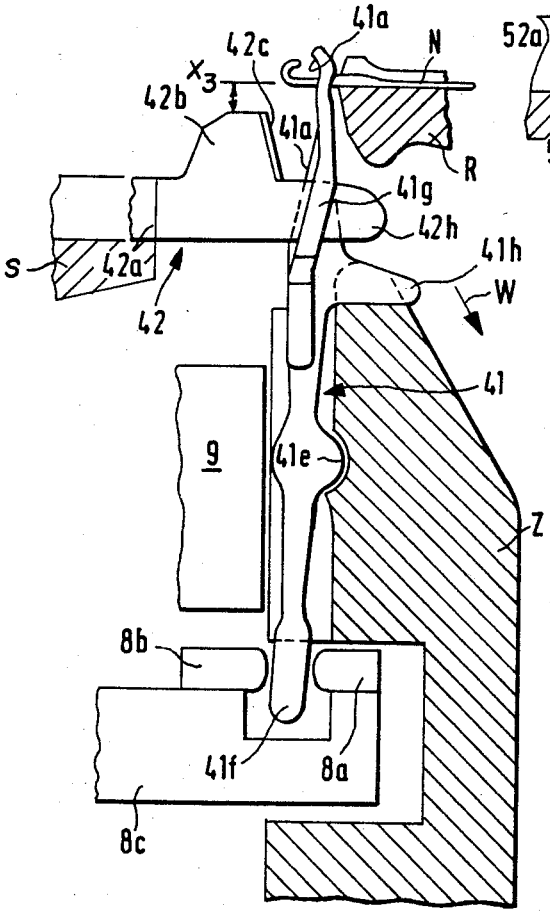
FIG. 12 a view like FIG. 1 of a fifth embodiment of the invention.
Figure 13:
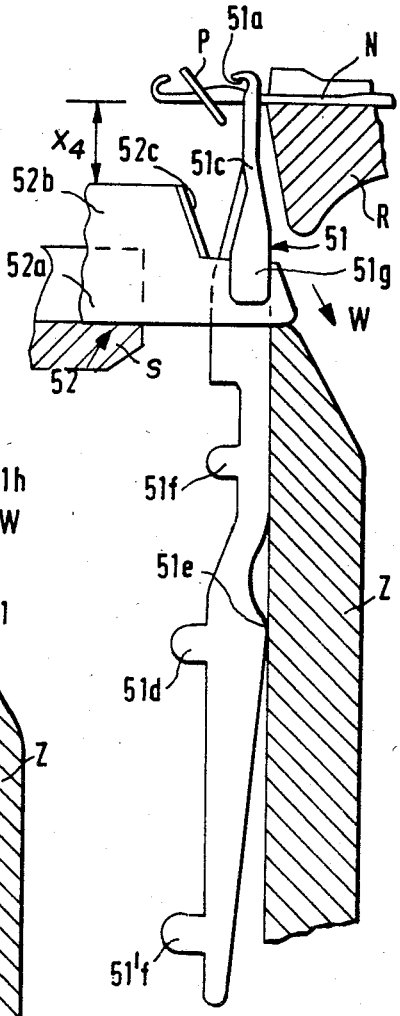
FIG. 13 a fourth embodiment of the invention in a view like that of FIG. 12.

As is seen in FIGS. 1 and 2, a circular knitting machine according to the invention has the usual cylinder Z, in which pile elements 1 are positioned, as well as a dial R, not shown in FIGS. 1 and 2 but shown in FIGS. 4, 12 and 13, in which needles N, shown as ordinary latch needles, are arranged for horizontal by a cooperating cam.

As is apparent from FIGS. 4 and 7, a knitted fabric G is produced from the needles N and taken down, in the direction of arrow W shown there, on the inside of the pile elements 1 and the cylinder Z in the longitudinal direction of pile elements 1. The pile elements 1 with their pile forming hooks formed as cooperate with dial needles N by their retraction simultaneously to stitch formation at a position as shown schematically in FIG. 2 to produce pile loops H on the outside of the knitted fabric G, in known manner.

In the embodiment of FIGS. 1 and 2, a pile loop H is formed, as shown schematically in FIG. 2, at a pile forming edge 1*a* formed as a draw-hook, and shown in the retracted position of the pile elements 1 in FIG. 2. After the previous knock-over of the needles N the pile element 1 is then extended to the position shown in FIG. 1, in which the thus formed pile loop H, held down by the fabric and the simultaneously projected needles N slips downwards over an extending bulge 1*b* on the shank of the pile element 1 and rests there. A previously formed pile loop H slips down further the shank of pile element and comes in contact with a cutting edge 1*c* arranged vertically on the pile element 1 and spaced a distance from the pile forming edge 1*a*. The loop that contacts cutting edge 1*c* is severed as will be further explained below. Thus the fabric is released from the pile elements 1 and can pull in and be drawn down further in the direction of the fabric take down W.

As is apparent from FIG. 1, the dial needles N are arranged with corresponding spacing $X_1$ above the upper end of cutting elements 2. The pile elements 1 in the slots of the cylinder Z can be raised if desired by a cooperating jack M of a known selection device. In particular, the vertical movement of the pile elements 1 is actuated by corresponding cams 3 on a butt 1*d*.

Associated with each pile element 1, is a cutting element 2, which is arranged in the same plane as the pile element 1, but radially outwardly thereof same in the same slot of the cylinder Z. Each cutting element 2 has a shaft 2*a*, which has the same thickness as pile element 1. At its upper end, the cutting member 2 has a cutting blade 2*b* with a cooperating cutting edge 2*c*, which in a manner to be further explained below is positioned so as to be operative together with cutting edge 1*c* of pile element 1 and cooperates therewith. The cutting blade 2*b* is bent away from the plane of shaft 2*a* by a projection 2*d* and is therefore arranged laterally adjacent pile element 1 in the region of its cutting edge 1*c*. If pile element 1 is retracted, as shown in FIG. 2, cutting element 2 pivots outwardly together with its cutting blade 2*b* and thus over the slot indicated at FK. In this way the cutting blade 2*b* is positioned either in the FIG. 1 position above the cylinder, or in the FIG. 2 position radially outside the cylinder and the slot FK. Thus the breadth of the slot simply has to correspond to the thickness of the pile element 1 or the shaft 2*a* of the cutting element 2 respectively.

To effect the pivotal motion of the cutting element 2 it is pivotally arranged by a connecting head 1*e* on the shank of pile element 1 and a cooperating recess 2*e* in the shank of cutting element 2. Recess 2*e* includes circular bearing surface, against which head 1*e* is received and is thus vertically movable together with pile element 1. Horizontal pressure cams 4 and 5 operate against butts 2*f* and 2*g* of the cutting element 2 in order to pivot the cutting element 2 at will, to and fro between the positions shown in FIGS. 1 and 2.

The cooperating cutting edge 2*c* on cutting blade 2*b* is inclined outwardly and also at a skew with respect to the cutting edge 1*c* of the pile element 1, as will be further explained below with reference to FIGS. 4 to 7, so that when cutting edge 2*c* passes cutting edge 1*c* by movement of the cutting blade 2*b* out of the FIG. 2 position and into the FIG. 1 position, in a scissor-like manner, an exclusively point contact is maintained under the counter-pressure, which assures a clean severing of the pile loop H in the area of the cuttoing edges 1*c* and 2*c*. Since the force required for severing is effected by pressure on butts 2*f* and 2*g* of the cutting element 2, no tension in the pile loop is required.

For stitch formation the needles N and the pile elements 1 are extended. Advantageously, the pile elements 1 may be extended previously, in order to prevent movement of the fabric G and the dial needles N by friction. The pile elements 1 are extended so far that they penetrate through the pile loop H with bulge 1*b* rising movement of fabric G being restrained by take-down tension acting in direction of arrow W. When the needles N are fully extended, pile elements 1 are retracted to the feeding position so that the pile loop H lying on the bulge 1*b* eventually expanding the pile thread within the stitch on the needle and thus tightens the pile thread on the needle shaft. Previously formed pile loops H are transported down by continuously knitting of the fabric and arrive in the area of the cutting edge 1*c* arranged at a position vertically downwardly on the pile element a distance a from the pile forming region 1*a*. Now the cutting pivot action of the cutting element 2 is effected by cam 4 pressing the butt 2*f* of the cutting element 2, so that the opposed cutting edge 2*c* rocks or slides along the cutting edge 1*c*. As a result the pile loops H lying in this area are cut. In this way, the fabric G is cleared from pile elements 1 and can pull in and further be taken down in the direction of the fabric take down W. FIG. 1 shows the situation at the end of the cutting stroke of cutting element 2. By maintaining a space a between pile forming edge 1*a* and the cutting edge 1*c* of each pile element 1, the cutting edges 1*c* and 2*c* are so arranged by a predetermined space $X_1$ that at least the pile loops H of the previously knitted two courses remain uncut and extended on the pile element 2. In this way, the subsequent reprotruding of stitches knitted from the pile thread is prevented. During the severing process the needles N are retracted to the feeding position. As is possible with rib machines, base (i.e. ground) and pile threads can be fed simultaneously, whereupon the needles N and pile elements 1 are retracted to the FIG. 2 position. Prior the retraction of the pile elements 1, cutting element 2 had to be pivoted by a cam 5 pressing the butt 2*g* into the FIG. 2 position, so that it is possible, with a cylinder extending as far as possible to the dial, to cover the pile elements 1 adequately preventing the cutting blade 2*b* to be engaged from slot FK.

Possibilities to produce a patterned fabric results by arranging a known per se patterning device to select pile elements 1 to form pile loops H and/or, in, retracting them to different extents. The present embodiment has the advantage that a cutting stroke of the cutting element is only effected when a pile loop H has been formed, so that unnecessary cutting strokes are avoided, if the cutting element remain unselected and a pressure to butt 2*f* of the cutting element 2 is not effected by cam 4. Since the severing of a pile loop is effected when a number of subsequent courses are knitted, a pile element 1 may remain unselected only in a limited number of courses, or severing must be ensured by predetermined systems in which all pile elements 1, but no needles N, are extended, so there is a sufficiently frequent cutting of the pile loops H.

Figure 3:
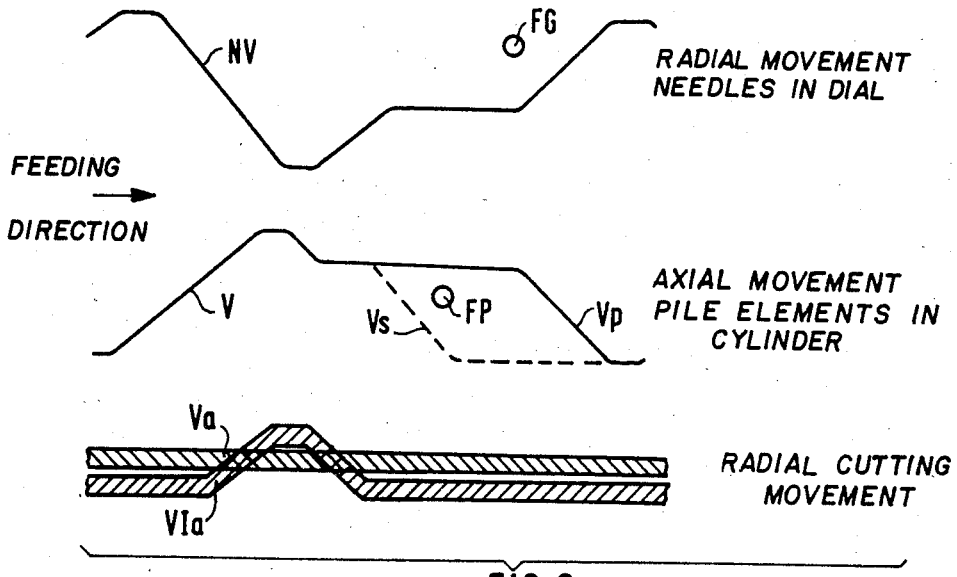

In order to avoid this limitation, or additional cutting systems needles N can be actuated as seen in FIG. 3 on curve NV. The pile elements 1 with the cutting elements 2 are arranged axially thereon on curve V and the cutting strokes of the cutting element 2 are shown on curve VIa, whereas curve Va illustrates the position of the cutting edge 1*c*, which is constant in the radial direction. As described above, all pile elements 1 are fully extended and subsequently retracted to reprotrude previously enlarged stitches. A selection device retracts pile elements 1 not selected for forming pile loops on curve Vs simultaneously with the termination of the cutting stroke. Pile thread is fed to the pile elements 1 remaining extended and to the needles N retracted to the feeding position pile thread being fed by feeder FP and the base thread by feeder FG, whereon the needles N and the pile elements 1, the latter on curve Vp, are retracted. In this operational sequence an unlimited arrangement of pile loops H is possible while cutting strokes are effected in every feeder position system where a stitch is formed.

Instead of connecting the cutting element 2 to the pile element 1 by means of its connecting head 1*e* in the axial direction, it is also possible to position the cutting element 2 in a sliding manner on pile element 1 so it always remaining at the same level. In this arrangement only pivoting movement is required for severing and the cutting blade 2*b* always remains above the cylinder Z.

In the illustrated embodiment this is achieved by having the cutting element 2 arranged on the radially outer edge of the shank of the pile element 1 in the same slot FK. Alternatively, the shank of pile element 1 could also be widened so that it projects out of slot FK, adjacent ones of such shanks forming slots themselves in which the shanks 2*a* of the cutting elements 2 can be arranged, without requiring any widening of slots FK circumferentially of the cylinder which would result to coarser cut.

An important advantage of the described for shanks 1*a* and 2*a* is that even in fine cuts, extremely rigid and large pile elements 1 and cutting elements 2 can be used. In a cut, if desired an arrangement of the two elements side by side with corresponding widening of the slot FK is practicable.

By knitting the fabric in the dial, fabric G is taken down parallel to the pile elements 1. This requires no further auxilary means to transport the pile loops H gradually from the pile forming edge 1*a* downwards to the area of the cutting edge 1*c*. Based on the amount of the space $X_1$ from the cutting edge 1*c* 2*c* to the backs of the needles N located in the dial and corresponding to the pile forming edge 1*a* and depending also on the course density the number of courses which have to be knit to transport the pile loops H to the cutting area can be determined. As the pile loops H cannot clear from the pile element 1, before being cut and while held at least temporarily extended a correct plating of base and pile threads and therefore a desired jersey side of the fabric is ensured.

The described embodiment requires, on account of the illustrated arrangement of the cutting element 2, a very long sized pile element 1 and relatively complicated caming control not only of the pile element 1 but also of the cutting element 2. Since a vertical movement of the cutting element 2 is not required cutting element 2 can be arranged outside the cylinder, as sinker normally are in an outside dial ring such as a sinker ring.

Such an arrangement is shown in FIGS. 4 to 7. Since the arrangement of a sinker ring and the corresponding cam attachment with respect to the cylinder Z is generally known, these two parts are not shown in detail, to improve the clarity of the drawing but a sinker ring S and the corresponding cam attachment SC is schematically illustrated in FIGS. 4, 7 and 12.

In the embodiment of FIGS. 4 to 7, the same reference numerals are used for corresponding parts as in the embodiment of FIGS. 1 and 2, but increased by 10. Thus in this case the pile element 11 has a pile forming portion 11*a* formed as a hook, an extending bulge 11*b* and a cutting edge 11*c*. The cutting element 12 has a shank 12*a*, here positioned in slots of the sinker ring S a cutting blade 12*b* and a cutting edge 12*c*, and is actuated by cams SC through butt 12*f*. For an exactly lateral sliding of the cutting element 2 in the embodiment of FIGS. 1 and 2, a projection 1*h*, is provided on the cutting element 2 in the area of the cutting blade 2*b* in each of its pivotal positions, so that it is not lifted or pushed off by the skew angle of the cooperating cutting edge 2*c*. In the embodiment of FIGS. 4 to 7, a projection 12*h*, shown in FIGS. 4 and 7, is arranged on the cutting element 12. When the cutting element 12 is retracted, projection 12*h* ensures the desired lateral position of cutting element 12 relative to pile element 11 thereby assuring that the cutting edges 11*c* and 12*c* slide properly relative to each other.

Figure 5:
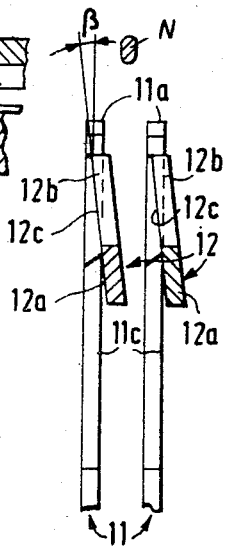

Also in the FIGS. 4 to 7 embodiment, pile elements 11 are actuated vertically either by a butt—not shown—or by a selection device. Additionally, sinker ring S is arranged so that the cutting elements are positioned in place of sinkers and are either extended or retracted horizontally by the butt 12*f*. Cooperating with camming SC the forward end of the cutting element 12 with the cooperating cutting edge 12*c* can be completely or partially inclined toward the axis of pile element 11, in order to have an angle of inclination or a skew angle $\beta$ shown in FIG. 5. In the embodiment of FIGS. 4, 5 and 7, cutting element 12 is made plane or flat and arranged in the sinker ring S so as to form an angle of inclination or a skew angle $\beta$ with corresponding slots of the sinker ring. The embodiment illustrated in FIG. 6, differs in that the shanks 12*a* of the cutting element 12 are vertically positioned in their width or height direction in the sinker ring S, but the cutting blades 12*b* are correspondingly skewed with respect to the plane of shank 12*a* and projection 12*h*, as is readily apparent from the plan view of cutting member 12 in FIG. 6. The cooperating cutting edge 12*c* always makes an offset angle $\alpha$ with respect to cutting edge 11*c*, as seen in FIG. 4. In this way, mutual contact is produced between the cutting portion of the pile element and the cooperating cutting edge of cutting element only at one moving or varying point, as is known in the art of making scissors, so that definite cutting conditions always apply, and the cutting edges can sharpen each other. In the embodiment of FIG. 6, the cutting elements 12 are positioned with their widthwise extension vertically in the sinker ring S, but slightly inclined in the circumferential direction, differing therefore from the radial orientation of the needles shown in phantom lines, so as to facilitate a resilient contact of the cutting elements 12 on the corresponding pile elements 11, the elastic deformations under this contact pressure and hence the amount of contact pressure is adjustable by circumferential adjustment of the position entire sinker ring S.

The knitting of pile loops H is effected as described in the embodiments of FIGS. 1 and 2. After forming (knock over of) the knitted course, as seen from FIG. 4, the pile elements 11 and needles N are projected. The raising of the pile elements 11 effects a lengthening of the pile loops when these loops pass over extending bulges 11*b* so that when the stitches clear the latches on the the needle shanks they will appear as enlarged stitches. While the needles are retracted to the feeding position, the cutting stroke is effected by actuating the cutting elements 12 on butt 12*f* by a corresponding cam SC as seen in FIG. 7. Simultaneously to the feeding of base and pile thread in front of and behind the pile element 11, the cutting element 12 is retracted. Successively needles N and the pile elements 11 are fully retracted for stitch and pile loop formation, as illustrated in FIG. 4. By a spaced arrangement $X_2$ of the cutting elements 12 beneath the needles N it is ensured that at least the pile loop H of the previously knitted course remain uncut. In knitting patterned fabrics, the pile elements 11, needles N and the cutting elements 12 are all preferably actuated corresponding to the motion curve referred to in accordance with FIG. 3.

Alternatively, another possible actuation curve is shown in FIG. 8, where the pile loops are knitted in as tuck stitches, with this occurring in the following manner. In the embodiment according to FIGS. 4 to 7 a portion of the needles N are moved along curve N1 and all pile elements 11 move along curve V. Since in tuck stitching the pile loop H must not be extended subsequently the cutting element 12 can be arranged with such a small distance $X_2$ below the backs of the needles N that the pile loops H are cut after they are formed by the successive cutting projection. If desired, the pile elements 11 not selected for engaging the pile thread P are then retracted on curve Vs, while the needles N are further extended to the position required for pile loop formation. The pile thread P is fed to the further extended pile elements 11 by feeder FP, whereupon these are retracted on curve Vp for loop formation. As soon as the hooks of the pile elements 11 pass the needles N, at least a portion of the needles remaining in the miss position will raise on curve N2 into the knit position or on curve N3 into the tuck position. Preselected needles can remain on curve N4 in the miss position. After all extended needles N are retracted to the feeding position, feeder FG feeds the base thread. Then all needles are retracted for stitch formation (or moved to their knock over position).

While, for the production of unpatterned (plain) cut pile fabric, a selection of the pile elements 11 is not required, an arrangement of the pile elements M fixedly in the cylinder, in a similar way, as will be detailed below in accordance with the embodiment of FIGS. 12 and 13 is possible. The pile elements then project with a pile forming portion stationary between the extended needles N in the dial R. The difference in height of the pile forming portion of the pile elements for knitting the pile loops and the knock-over edge of the dial for knitting the base fabric determines the length of the pile loops H. By using pile elements with pile forming portions having different heights relative to the dial variations in the pile height or loop lengths can be effected by selection or preselected insertion of the different pile elements. For the production of plain fabrics this arrangement has the advantage that no cylinder caming is required to actuate the pile elements.

Since the pile loops are only cut when at least a subsequent course has been knitted, the cutting process is substantially, and with fixed pile elements, absolutely independent from the knitting process. With vertical-movable pile elements 1 or 11, on the contrary, the stroke of the cutting elements 2 or 12 should occure when the pile elements 1 or 11, will not be actuated, (i.e. should occur preferably in their miss or extended position).

As explained in accordance with the embodiment of FIGS. 1 and 2, if the pile elements 1 or 11, are selected a cutting process is required at least after knitting a number of subsequent courses. Analogous to this, if all pile elements and cutting elements generally are actuated to the cutting process, only to predetermined feeders or systems of the knitting machine a cutting action of the cutting elements is required. In this way, the abrasion of the cutting edges is reduced.

Since in knitting in the pile loops H as tuck stitches, advantageously only a portion of the pile elements are raised in a fixed order at consecutive feeders, advantageously a cutting action can also be effected with only a corresponding portion of the cutting elements in the same or a predetermined sequence. This also results in a decrease amount of abrasion of the cutting edges. In this way it is also possible to arrange a smaller number of pile elements and cutting elements than there are knitting needles. Thus if pile loops are knitted in from every fourth needle only and this is centered at subsequent feeders, whereby every second needle never is raised to form pile loops, only a half of the pile elements 1 or 11 and cutting elements 2 or 12 must be positioned in the cylinder and the sinker ring. Thus, if it should be desired that only half as many slots are required, these can be wider whereby even stronger pile elements and cutting elements can be arranged.

In the embodiments described, the pile loops H will be formed around pile elements 1 or 11 tightly so that, if there is a failure in the severing operation through poor contact of the cutting edges. If the forming is too tight between the contact of the pile loop to the pile element, the cooperating cutting edges 2*c* or 12*c* can be deflected away from the cutting edges 2*c* or 11*c* by the pile loops H. This can be prevented if the pile loop as a result of a suitable shape of the contact face of the pile element 1 or 11 does not wind around at the position of the cutting edges 1*c* or 11*c*.

Figures 9, 10, 11:
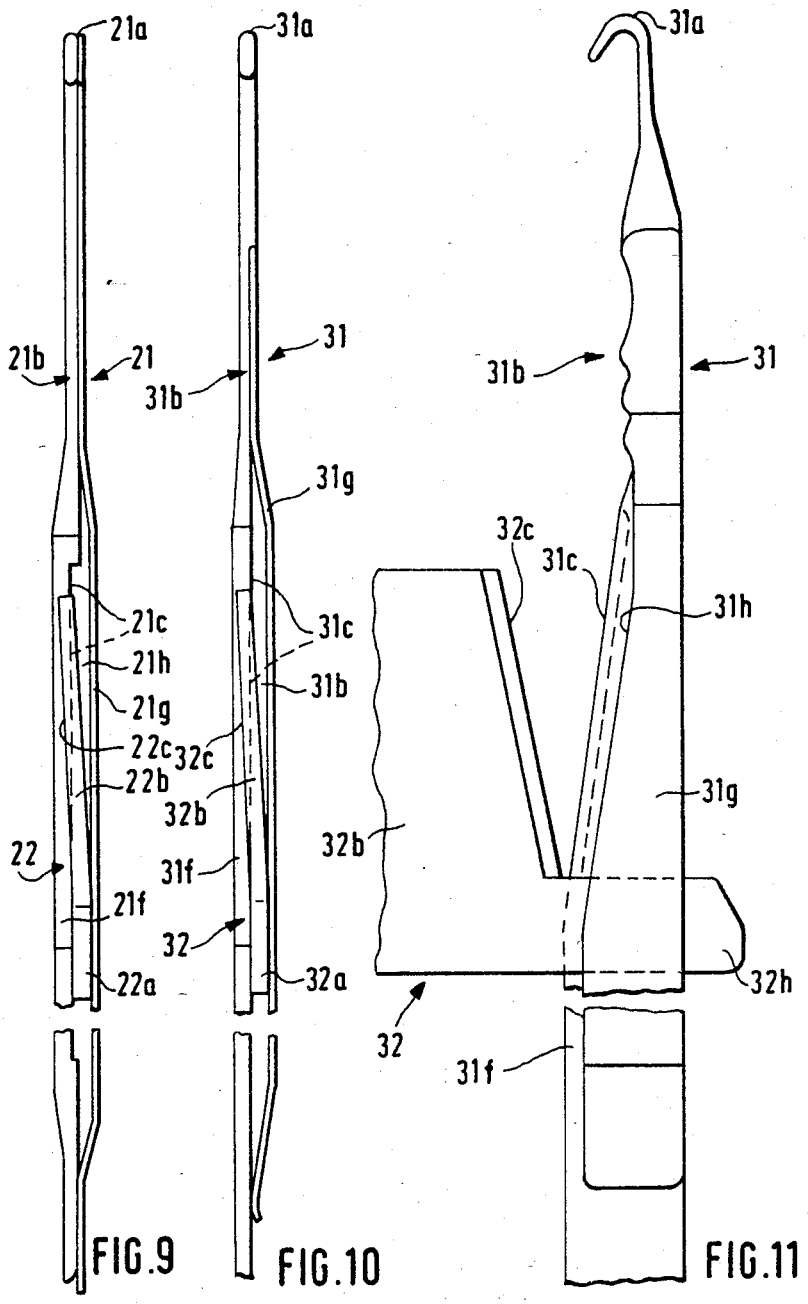

In FIGS. 9 to 11 are illustrated two embodiments, in which the pile elements 21 or 31 are formed in a bicomponent manner in the area of the cutting edges 21*c* or 31*c* where the cooperating cutting edge of the cutting elements 22*c* or 32 pass between the two portions of the pile element.

Also in these two embodiments, and in the later embodiments, the same reference numerals are used for corresponding parts, but increased by 10.

In the embodiment of FIG. 9 the pile element 21 includes two individual portions which are positioned side by side with their surfaces facing each other. These comprise a massive portion 21*f*, and a thin portion 21*g* which lies over it in side elevation, which is not shown. Both portions 21*f* and 21*g* are so shaped in the area where the cutting element 22 with the cooperating cutting edge 22*c* will pass between both portions. For example, portion 21*f* is reduced in thickness, as at 21*b*, and portion 21*g* cranked, so that the cutting element 22 can be flexibly pressed on the cutting edge 21*c* and can be guided between the portions 21*f* and 21*g*. As a result of the skewness of the cutting blade 22*b*, the cutting element 22, when passing through the opening between the portions 21*f* and 21*g*, is deflected and also bends out the thin portion 21*g*. On that account it is advantageous if the portion 21*g* is sprung into contact with or resiliently pressed onto the massive portion 21*f*. In the axial region of the cutting edge 21*c*, the thin, resilient portion 21*g* is radially set back from the cutting edge 21*c* with respect to the cylinder axis, in order to prevent a jamming of the pile loop in the cutting action on the right hand side of the cutting element 22 as seen in FIG. 9. The pile loop passes across the slot 21*h* and is not twisted round the face of the cutting edge 21*c*, but is held away therefrom by the portion 21*g*, so that favorable cutting conditions are obtained and jamming of the pile thread between the cutting edges 21*c* and 22*c* and a bad cut is avoided.

In the embodiment of the pile element 31 of FIGS. 10 and 11 the pile element 31 is formed almost completely from the portion 31*f*, and the sprung or resilient portion 31*g* is connected to the upper flank of portion 31*f* between the cutting edge 31*c* and the pile forming portion 31*a*, but merely sprung or resiliently pressed against it below the cutting edge 31*c*. In this way too great a formation of the pile loop is avoided, without obstructing the movement of the cooperating cutting edge 32*c* and the cutting element 32. The extending of previously formed pile loops is effected by the wavy form of the upper part of the pile element 31 shown at 31*b*.

As seen in FIG. 11, the forward edge of the portion 31*g* is somewhat set back from cutting edge 31*c* of the component 31*f* here, as already explained in accordance with the embodiment of FIG. 9, in order to hold the pile loops over the opening 31*h* and spaced away from cutting edge 31*c*, and to avoid a jamming of the cut end of the pile loop on the portion 31*g* on the side of the cutting edge 31*c*.

In FIGS. 12 and 13, finally, pile elements 41 and 51 are shown which are not actuated vertically or operate like the pile elements which have already been referred to in accordance with the embodiment of FIGS. 4 to 7 as an alternative arrangement without vertical movement. In order that the lengths of the pile loops can be altered quickly, pile elements 41 and 51 are pivotally supported on pivots 41*e* and 51*e*. In this way, the formation of longer pile loops is effected more quickly, because the needles N and the pile elements 41 and 51, have simultaneous movements in opposite directions, the movement of the pile elements 41 and 51 is adjustable.

In the embodiment according to FIG. 12, the pile element 41 is provided with a component 41*g*, corresponding to the previous features of FIGS. 10 and 11, and radially slidable with a projection 41*h* in a slot of the cylinder Z. The pile element 41 is held in position by a ring 9. The pile element 41 projects downwardly with a butt 41*f* out of the slot in the cylinder Z. The butt 41*f* is running in a track formed by cam 8*a* and 8*b*. The cams 8*a* and 8*b* are secured on a movable carrier 8*c*. By adjusting the carrier 8*c*, the cams 8*a* and 8*b* control a variable pivotal movement of the pile element 41. In this way an adjustable pivotal movement of the pile elements 41 and therefore an adjustment of the loop length of the pile loops can be realized.

The pile element 51 of FIG. 13 is pivotable in the cylinder Z, about a pivot point 51*e* and has an additional butt 51*d* by means of which pile elements 51 can be moved in their lengthwise direction. Further butts 51*f* and 51'*f* cooperate with pressing cams described in accordance with FIG. 1 and FIG. 2 which pivot the pile element 51 into the desired position for pile formation. If the pile elements 51 have predetermined butts 51*d* of different heights or differently arranged, such different pile elements 51 can be inserted and, can be raised to different, levels. Therefore butts 51'*f* are also selected at different heights. On each selection, differently acting pressing cams can form different lengths of pile loops in the same course. The selection of the pile elements 51 can also be effected by a known per se selection device. In this embodiment there is the additional advantage, with regard to the prior art known from West German Pat. No. 1,935,224 (FIGS. 5 and 6) or West German Pat. No. 656,588, that the loop length is not fixed by different shaped edges of the pile elements 51 to all systems or all feeders, but can be adjusted as desired at each feeder. Moreover selected pile elements 51 can be so effected to different heights that the production of patterened loop and cut pile fabric is possible.

In the foregoing description reference numerals which have not been referred to although shown in the drawings are correlated with correspondingly lower reference numerals in the manner described, and thus further features are illustrated in the drawings that can be provided identically or analogously in the different embodiments. In this regard therefore the description will suffice in order to avoid repetition of the explanation of the different embodiments with regard to similar or analogous embodiments.

What is claimed is:

1. A knitting machine for producing cut pile fabric, said machine including a dial and cylinder together with a plurality of needles and pile forming elements, respectively, said pile forming elements each having a pile loop forming portion at one end thereof with the shank of the pile element extending therebelow, a cutting edge formed so as to extend along said shank, cutting means positioned a predetermined distance below said dial needles and arranged so as to effect a substantially transverse slicing engagement with said cutting edge, said predetermined distance being able to accommodate at least one previously formed, unsevered pile loop, so that said at least one pile loop previously drawn along the shank of the pile element can be severed by the relative movement between said pile element and said cutting means but only after after an additional pile loop is formed on said pile forming element so that at least two loops are retained on said pile element prior to cutting, and a guide ring located radially outwardly of said pile forming elements, said guide ring having a plurality of radially extending grooves for receiving said cutting means therein so that said cutting means can move radially relative to said cutting edge.

2. A knitting machine for producing cut pile fabric, said machine including a dial and cylinder together with a plurality of needles and pile forming elements, respectively, said pile forming elements each having a pile loop forming portion at one end thereof with the shank of the pile element extending therebelow, a cutting edge formed so as to extend along said shank, cutting means positioned a predetermined distance below said dial needles and arranged so as to effect a substantially transverse slicing engagement with said cutting edge, said predetermined distance being able to accommodate at least one previously formed, unsevered pile loop, so that said at least one pile loop previously drawn down along the shank of the pile element can be severed by the relative movement between said pile element and said cutting means but only after an additional pile loop is formed on said pile forming element so that at least two loops are retained on said pile element prior to cutting, wherein each of said pile forming elements further includes a tensioning bulge positioned between said pile loop forming portion and said cutting edge over which said pile loops pass as they are pulled along the pile element subsequent to formation and before engaging said cutting edge.

3. A knitting machine for producing cut pile fabric, said machine including a dial and cylinder together with a plurality of needles and pile forming elements, respectively, said pile forming elements each having a pile loop forming portion at one end thereof with the shank of the pile element extending therebelow, a cutting edge formed so as to exend along said shank and cutting means positioned with respect to each said pile element so as to effect a substantially transverse slicing engagement with said cutting edge at a predetermined distance below said dial needles, said predetermined distance being able to accomodate at least one previously formed, pile loop, so that said at least one pile loop previously drawn down along the shank of the pile element can be severed by the relative movement between the cutting edge on said pile element and said cutting means but only after an additional pile loop is formed on said pile forming element so that a plurality of loops are on said pile element prior to cutting and less than all of said plurality of loops are cut.

4. A machine as claimed in claim 3, wherein said cutting means are pivotally supported on said pile forming elements.

5. A machine as claimed in claim 4, wherein the cylinder has grooves accommodating the pile forming elements and the cutting means are arranged radially outwardly on said pile forming elements in the grooves of the cylinder.

6. A machine as claimed in claim 3, in which the pile forming element has a slot of which one edge constitutes the cutting edge with said cutting member passing through the slot.

7. A knitting machine as in claim 3, wherein said cutting means includes a resilient cutting blade that compressively engages said cutting edge during the cutting stroke.

8. A knitting machine as in claim 3, wherein the relative movement between said cutting edge and said cutting means occurs between a first retracted position located radially outwardly of each said pile element and a second cutting position located radially inwardly of said first position, so that said cutting means effects a full cutting stroke relative to said cutting edge as movement occurs from said first to said second position.

9. A knitting machine as in claim 8, wherein said relative movement produces mutual contact between said cutting means and said cutting edge only along one moving point therebetween.

10. A knitting machine as in claim 8, further including a sinker ring provided with slots positioned radially outwardly of said cylinder, and wherein said cutting means are located in the sinker ring slots and cam means for actuating said cutting means between said first and second positions.

11. A knitting machine as in claim 3, wherein said cutting means includes a cutting element having a cutting portion with at least the cutting portion thereof being skewed with respect to said cutting edge.

12. A knitting machine as in claim 3, wherein said cutting means includes a cutting element having a cutting portion with said cutting element and said cutting portion being located along a common plane.

13. A knitting machine as in claim 10, wherein said cutting means is positioned so as to be skewed with respect to a plane defined by and parallel to said cutting edge.

14. A knitting machine as in claim 3, wherein said cutting means includes guide means for maintaining the desired relative positioning between said cutting means and said cutting edge.

15. A knitting machine as in claim 3, wherein said pile elements further include pile loop tensioning means positioned between said pile loop forming portion and said cutting edge so that following pile loop formation as the knit fabric is collected, the pile loops being successively formed will be drawn down said shank over said pile loop tensioning means prior to the pile loops being drawn downwardly to engage said cutting edge.

* * * * *